US008459473B2

(12) United States Patent
Wang

(10) Patent No.: US 8,459,473 B2
(45) Date of Patent: Jun. 11, 2013

(54) LINKING STYLE HANGING CLOSET

(76) Inventor: Wen-Tsan Wang, Taipei (TW)

( * ) Notice: Subject to any disclaimer, the term of this patent is extended or adjusted under 35 U.S.C. 154(b) by 229 days.

(21) Appl. No.: 12/982,844

(22) Filed: Dec. 30, 2010

(65) Prior Publication Data

US 2012/0168395 A1 Jul. 5, 2012

(51) Int. Cl.

| | |
|---|---|
| ***A47F 5/08*** | (2006.01) |
| ***A47F 7/24*** | (2006.01) |
| ***A47F 5/0892*** | (2006.01) |
| ***A47G 25/746*** | (2006.01) |
| ***A47G 25/54*** | (2006.01) |

(52) U.S. Cl.
USPC ..... 211/118; 211/85.3; 211/36

(58) Field of Classification Search
USPC ..... 211/118, 113, 117, 85.2, 85.3, 34–38, 211/10; 312/3–6; 206/278.1; 383/98; 150/110
See application file for complete search history.

(56) References Cited

U.S. PATENT DOCUMENTS

| | | | | | |
|---|---|---|---|---|---|
| 1,914,967 | A | * | 6/1933 | Bebb | 432/259 |
| 1,983,307 | A | * | 12/1934 | Regenhardt | 312/107 |
| 2,244,887 | A | * | 6/1941 | Manley | 312/6 |
| 2,533,725 | A | * | 12/1950 | Eisenberg | 211/63 |
| 2,845,185 | A | * | 7/1958 | Winderweedle, Jr. | 108/164 |
| 2,919,045 | A | * | 12/1959 | Waugh et al. | 220/4.34 |
| 3,669,276 | A | * | 6/1972 | Woods | 211/34 |
| 3,885,845 | A | * | 5/1975 | Krieks | 312/265 |
| 4,108,084 | A | * | 8/1978 | Fink | 108/29 |
| 4,169,639 | A | * | 10/1979 | Zola | 312/265 |
| 4,382,640 | A | * | 5/1983 | Kashden | 312/5 |
| 4,518,089 | A | * | 5/1985 | Campbell | 211/118 |
| 4,523,526 | A | * | 6/1985 | O'Neill | 108/149 |
| 4,739,809 | A | * | 4/1988 | Adams | 150/112 |
| 5,125,519 | A | * | 6/1992 | Cambria | 211/118 |
| 5,542,758 | A | * | 8/1996 | Brown | 312/249.2 |
| 5,598,923 | A | * | 2/1997 | Owens | 206/370 |
| 5,779,033 | A | * | 7/1998 | Roegner | 206/6.1 |
| 5,899,838 | A | * | 5/1999 | Jacobs | 482/142 |
| 6,209,734 | B1 | * | 4/2001 | Wang | 211/87.01 |
| 6,318,822 | B1 | * | 11/2001 | Wang | 312/111 |
| 6,354,232 | B1 | * | 3/2002 | Hulke | 108/149 |
| 6,719,157 | B2 | * | 4/2004 | Stoddart et al. | 211/118 |
| 6,732,659 | B2 | * | 5/2004 | Poon | 108/42 |
| 6,764,144 | B2 | * | 7/2004 | Insalaco et al. | 312/108 |
| 6,837,385 | B2 | * | 1/2005 | Bennett et al. | 211/118 |
| 7,165,687 | B1 | * | 1/2007 | Stevens et al. | 211/86.01 |
| 7,258,232 | B2 | * | 8/2007 | Bradford et al. | 206/386 |
| D566,986 | S | * | 4/2008 | Greiner | D6/411 |
| D606,334 | S | * | 12/2009 | Clark et al. | D6/467 |
| 7,681,728 | B2 | * | 3/2010 | Sabounjian | 206/278.1 |
| 7,744,161 | B2 | * | 6/2010 | Berg et al. | 297/440.13 |
| 7,810,655 | B2 | * | 10/2010 | Wang | 211/118 |

(Continued)

*Primary Examiner* — Jennifer E Novosad
(74) *Attorney, Agent, or Firm* — Leong C. Lei

(57) ABSTRACT

A hanging closet includes closet body having horizontal partition panels connected between two opposing sidewalls thereof at different elevations to divide the holding space of the closet body into vertically spaced storage spaces, first sleeves located on each sidewall of the closet body at different elevations, suspension flaps each having a fixed end affixed to one sidewall of the closet body between two first sleeves and a free end provided two second sleeves that are spaced at a distance equal to the length of the first sleeves, and rod members insertable into the first sleeves and the second sleeves to secure the free end of each suspension flap to one associating sidewall of the closet body so that each suspension flap defines with the associating sidewall of the closet body a storage space.

4 Claims, 7 Drawing Sheets

U.S. PATENT DOCUMENTS

| | | | | |
|---|---|---|---|---|
| 7,954,639 | B2 * | 6/2011 | Carney et al. | 206/579 |
| D651,830 | S * | 1/2012 | Sabounjian | D6/514 |
| 2005/0140253 | A1 * | 6/2005 | Fu | 312/6 |
| 2007/0131683 | A1 * | 6/2007 | Sabounjian | 220/9.1 |
| 2007/0200470 | A1 * | 8/2007 | Wang | 312/6 |
| 2011/0042335 | A1 * | 2/2011 | McNicholas | 211/85.3 |

* cited by examiner

LINKING STYLE HANGING CLOSET

BACKGROUND OF THE INVENTION a) Field of the Invention

The present invention relates to storage design technology and more particularly to a linking style hanging closet, which facilitates linking of one hanging closet to another to establish a combination hanging closet assembly.

b) Description of the Related Art

Due to limited indoor house space in most families, wardrobe space in a house is limited, and therefore, hanging closets are highly invited. A hanging closet can be hung on a high place or in a wardrobe to keep storage clothes and other accessories in a classified manner. Regular commercial hanging closets are commonly made of canvass or any of a variety of tough and flexible sheet materials, having opposing top and bottom panels, opposing left and right panels and a back panel and defining therein a plurality of front-open type storage chambers for keeping things. A hanging closet further has a sleeve or Velcro tape provided at the top side for fastening to a hanging rod for hanging.

However, conventional hanging closets are commonly of a fixed design, not allowable for adjustment of the storage compartments to fit different requirements. There are some adjustable hanging closets commercially available, however these designs simply allow adjustment of the internal storage space. They do not have any adjustable external structure to provide an extra function.

SUMMARY OF THE INVENTION

The present invention has been accomplished under the circumstances in view. It is the main object of the present invention to provide a hanging closet, which facilitates linking of one hanging closet to another to establish a combination hanging closet assembly.

To achieve this and other objects of the present invention, a hanging closet comprises a closet body, which comprises two opposing sidewalls, a back wall, a plurality of horizontal partition panels connected between the two opposing sidewalls at different elevations and dividing the holding space of the closet body into vertically spaced storage spaces, a plurality of suspension flap each suspension flap having a fixed end fixedly connected to one sidewall of the closet body and a free end opposite to the fixed end, and fastening means adapted for securing the free end of each suspension flap to the associating sidewall of the closet body at a different elevation relative to the fixed end such that each suspension flap defines with the associating sidewall of the closet body a storage space.

In one embodiment of the present invention, the fastening means comprises a plurality of first sleeves fixedly and horizontally located on at least one of the two opposing sidewalls of the closet body, pairs of second sleeves respectively fixedly located on the free ends of the suspension flaps, and rod members insertable into the first sleeves and the pairs of second sleeves to secure the free ends of the suspension flaps to the first sleeves. The two second sleeves located on the free end of each suspension flap are spaced from each other at a distance equal to the length of the first sleeves so that the two second sleeves can be kept in axial alignment with one adjacent first sleeve and connected thereto by one rod member.

Further, the suspension flaps and the first sleeves of the fastening means can be alternatively arranged on one or each of the two opposing sidewalls of the closet body at different elevations corresponding to the partition panels.

Further, each suspension flap further comprises a third sleeve located on each of two opposing lateral sides thereof and extending in a perpendicular manner relative to the extending direction of the second sleeves, and a reinforcing rod member respectively inserted into each third sleeve.

In another embodiment of the present invention, the fastening means comprises multiple sets of hook holes located on at least one of the two opposing sidewalls of the closet body, and a set of hooks located on the free end of each suspension flap for fastening to one set of hook holes.

In still another embodiment of the present invention, the fastening means comprises a plurality of strips of loop material located on at least one of the two opposing sidewalls of the closet body, and a strip of hook material located on the free end of each suspension flap for fastening to one strip of loop material.

In still another embodiment of the present invention, the fastening means comprises a plurality of strips of hook material located on at least one of the two opposing Si of the closet body, and a strip of loop material located on the free end of each suspension flap for fastening to one strip of hook material.

DETAILED DESCRIPTION OF THE PREFERRED EMBODIMENT

Figure 1:
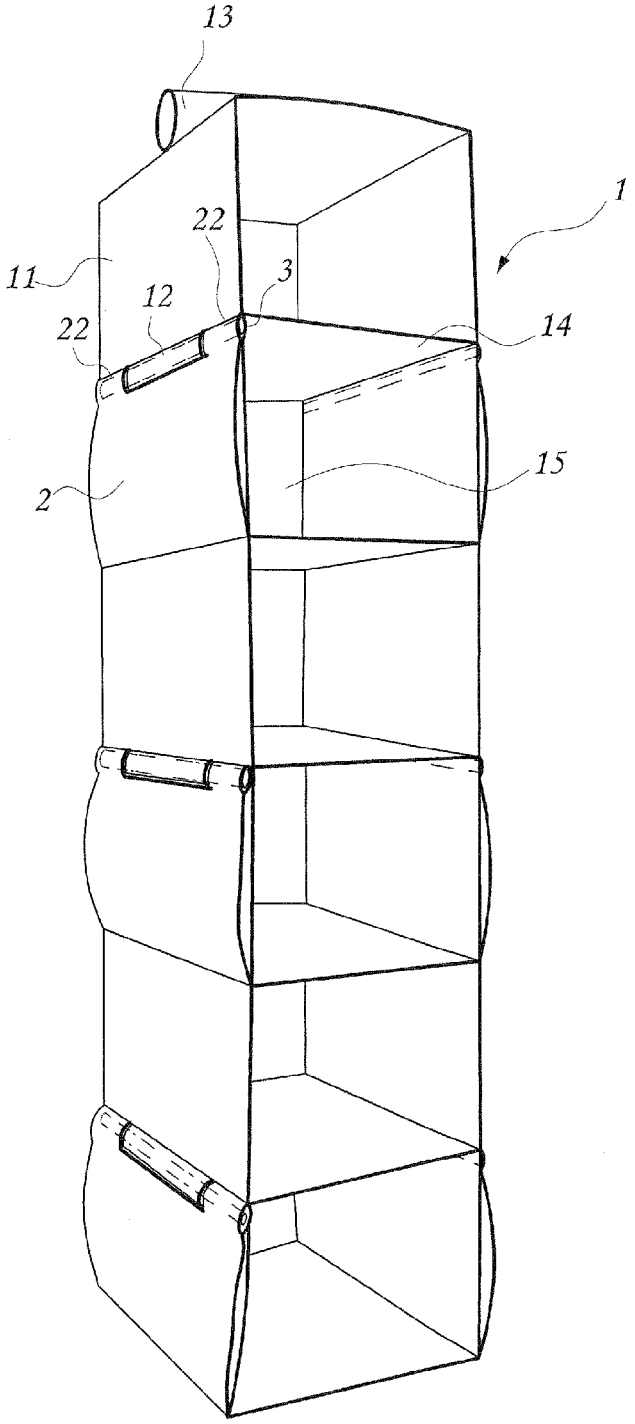
FIG. 1 is a schematic perspective view of a hanging closet in accordance with the present invention.
Figure 2:
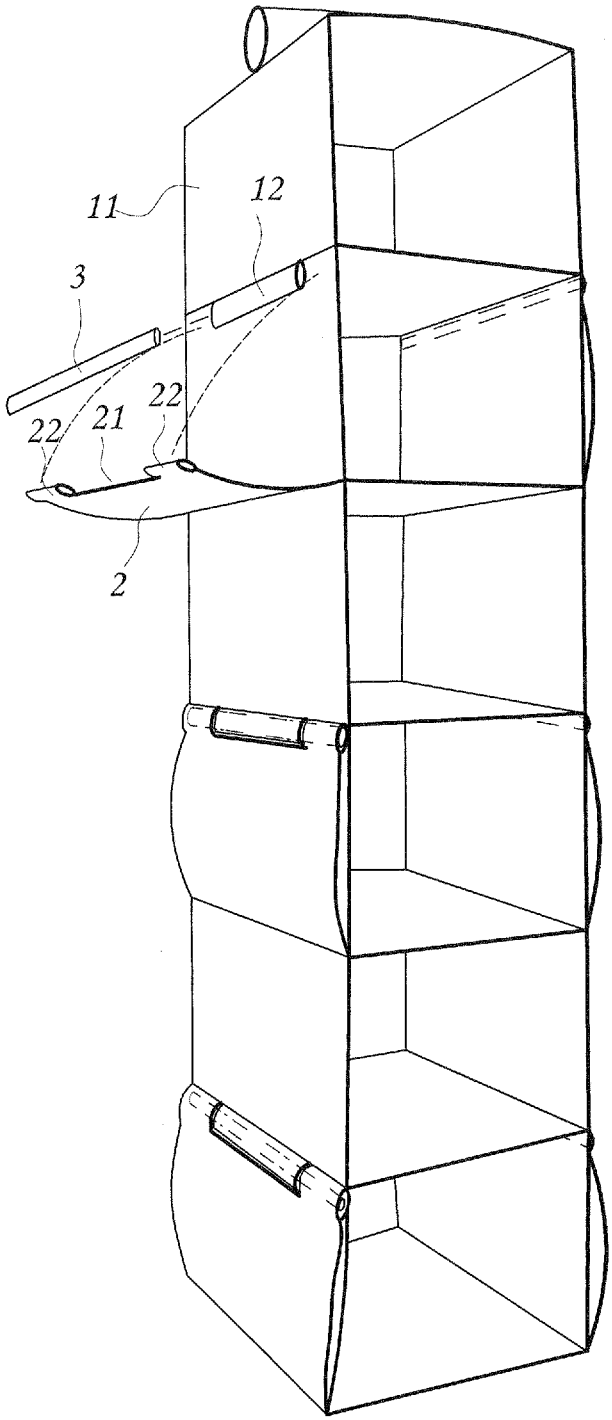
FIG. 2 corresponding to FIG. 1, illustrating the free end of one suspension flap detached from the associating sidewall of the closet body.

Referring to FIG. 1 and FIG. 2, a hanging closet in accordance with the present invention is shown comprises a closet body 1 having two opposing sidewalls 11, a back wall 15, and a plurality of horizontal partition panels 14 arranged between the two opposing sidewalls 11 at different elevations to divide the internal holding space of the closet body 1 into multiple vertically spaced storage spaces. The hanging closet further comprises a hanging ring 13 located on the top side of the closet body 1 for enabling the closet body 1 to be hung on a hanging rod in a wardrobe or cloth cabinet, a plurality of first sleeves 12 and a plurality of suspension flaps 2 alternatively arranged on the outer surface of one or each of the two opposing sidewalls 11 at different elevations corresponding to the partition panels 14, each suspension flap 2 having one end, namely, the fixed end fixedly fastened to the associating sidewall 11 and an opposite end, namely, the free end provided with two second sleeves 22 and an opening 21 between the two second sleeves 22, and a plurality of rod members 3 insertable through the second sleeves 22 of suspension flaps 2 and the first sleeves 12 to secure the free ends of the suspension flaps 2 to the first sleeves 12. The length of the opening 21 between the two second sleeves 22 of each suspension flap 2 is approximately equal to the length of the first sleeves 12 so that the two second sleeves 22 of each suspension flap 2 can be set into axial alignment with the adjacent first sleeves 12 and secured thereto by one rod member 3 such that each suspension flap 2 defines with the associating sidewall 11 of the closet body 1 a storage space for keeping things.

Figure 3:
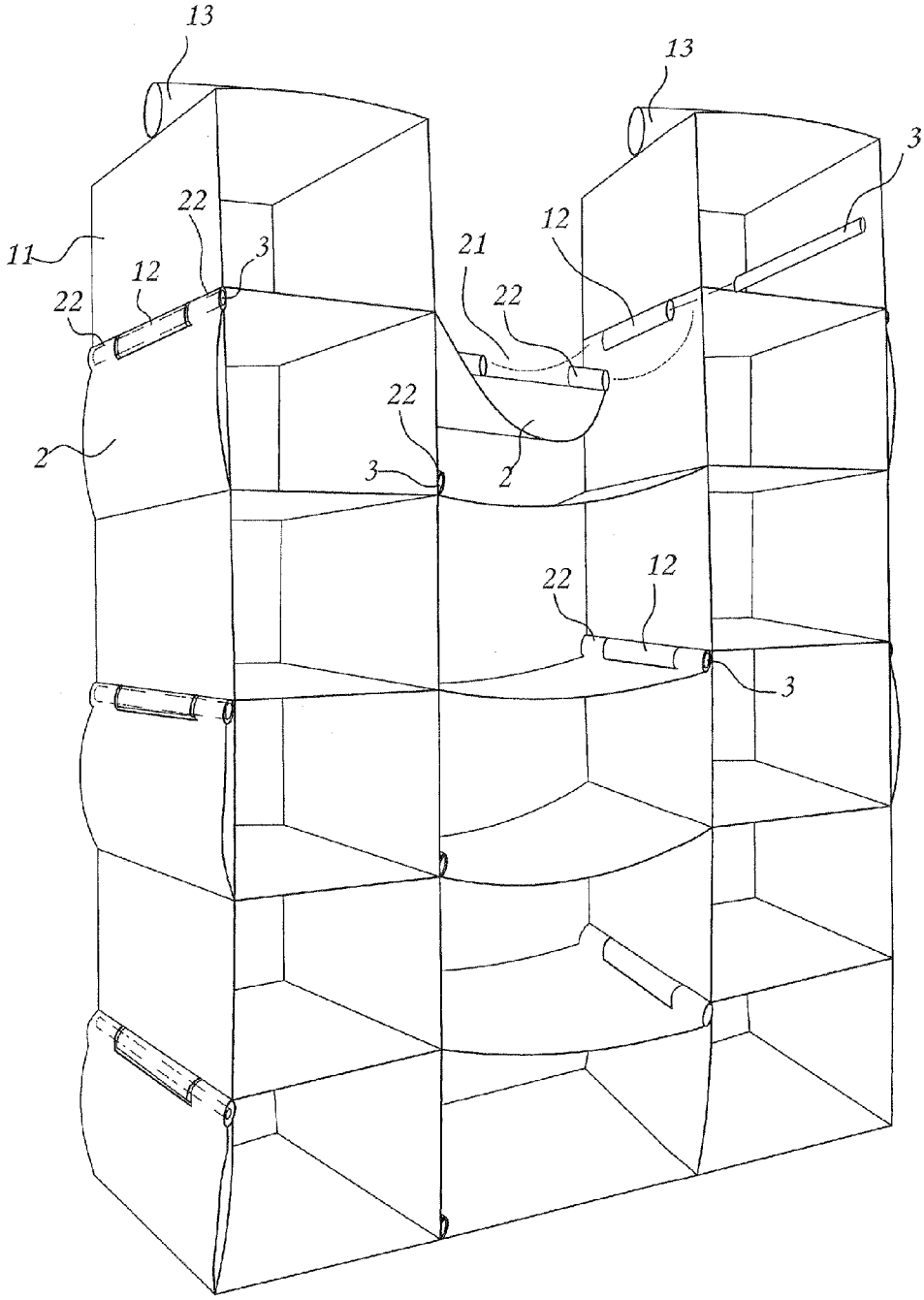
FIG. 3 is a schematic applied view of the present invention, illustrating two hanging closets linked together.
Figure 4:
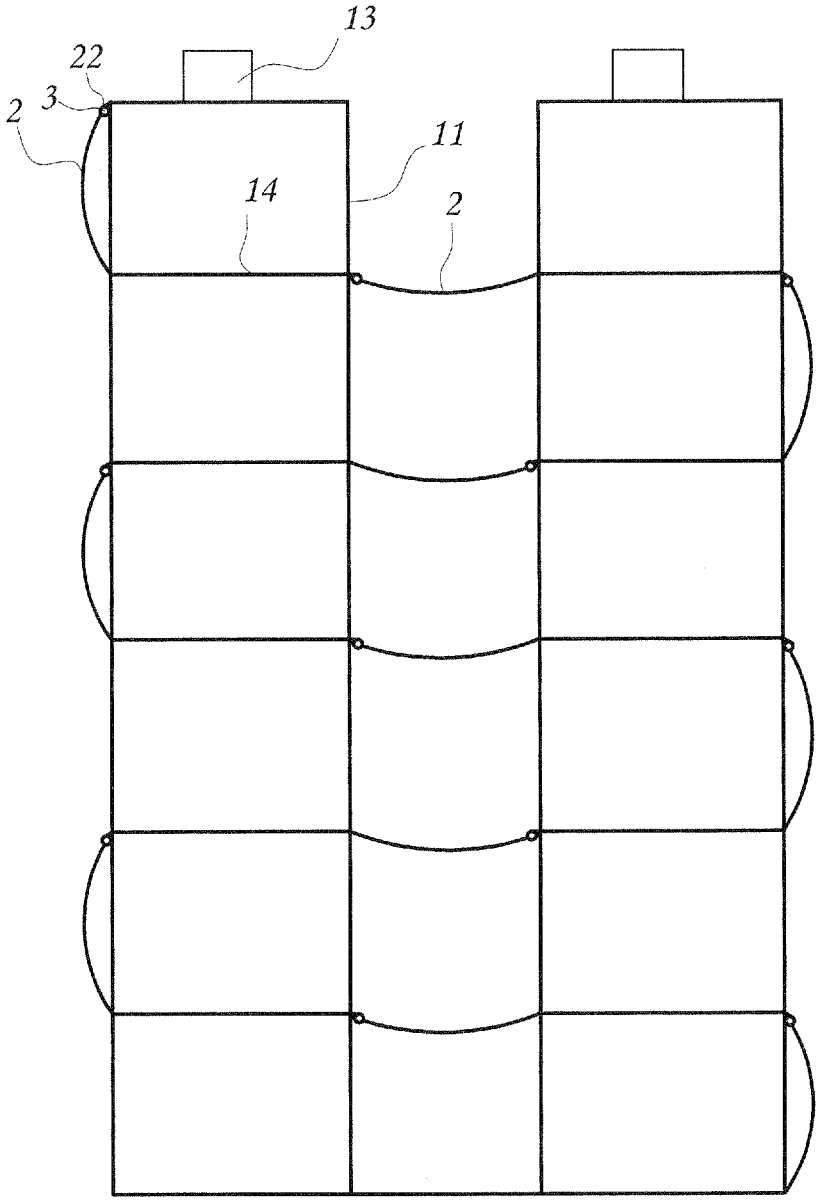
FIG. 4 is a schematic plain view of the present invention, illustrating two hanging closets linked together.

Referring to FIGS. 3 and 4, two hanging closets can be arranged in parallel and linked together by means of securing the two second sleeves 22 of each suspension flap 2 at one sidewall 11 of one hanging closet to one respective first sleeves 12 at one sidewall 11 of the other hanging closet by one respective rod member 3. At this time, multiple storage spaces are defined between the two hanging closets at different elevations.

Figure 5:
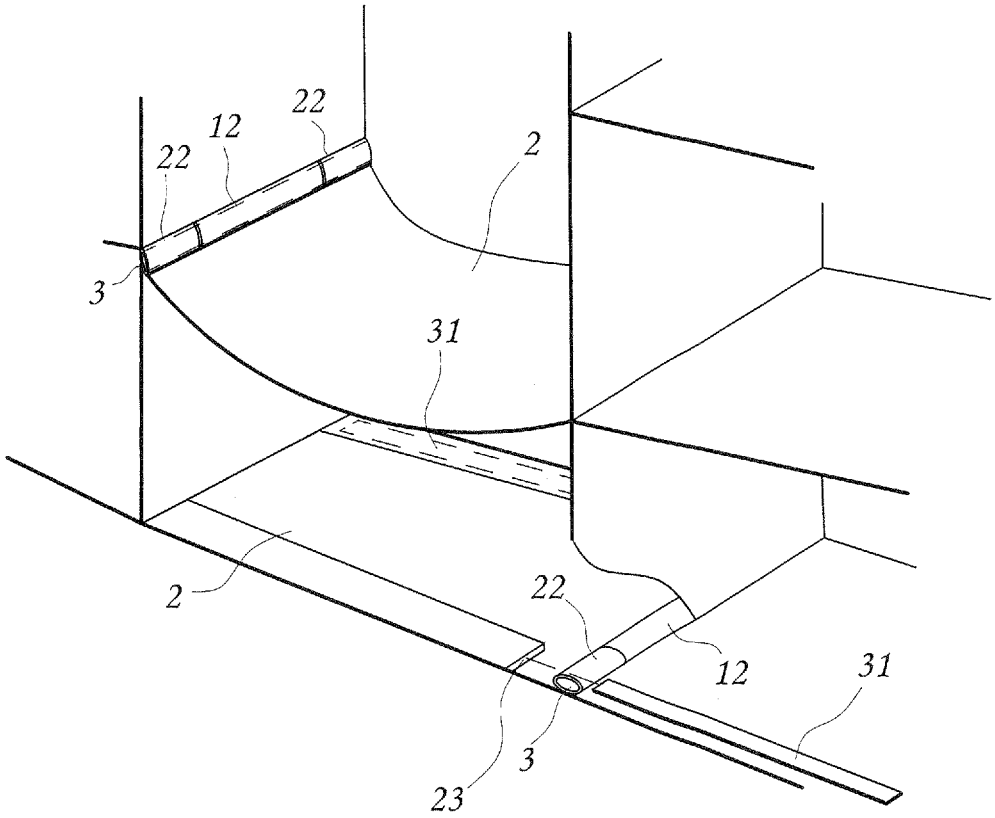
FIG. 5 is a schematic drawing of an alternate form of the present invention, illustrating a third sleeve located on each of two opposite lateral sides of each suspension flap for the mounting of one respective reinforcing rod member.

In an alternate form of the present invention as shown in FIG. 5, each suspension flap 2 can be made having a third sleeve 23 extending along each of two opposite lateral sides thereof in a perpendicular manner relative to the extending direction of the second sleeves 22. When the second sleeves 22 of each suspension flap 2 at one sidewall 11 of a first hanging closet are secured to one respective first sleeves 12 at one sidewall 11 of a second hanging closet by one respective rod member 3, reinforcing rod members 31 are respectively inserted into the third sleeves 23 to reinforce the structural strength of the respective suspension flaps 2 for holding things.

Figure 6:
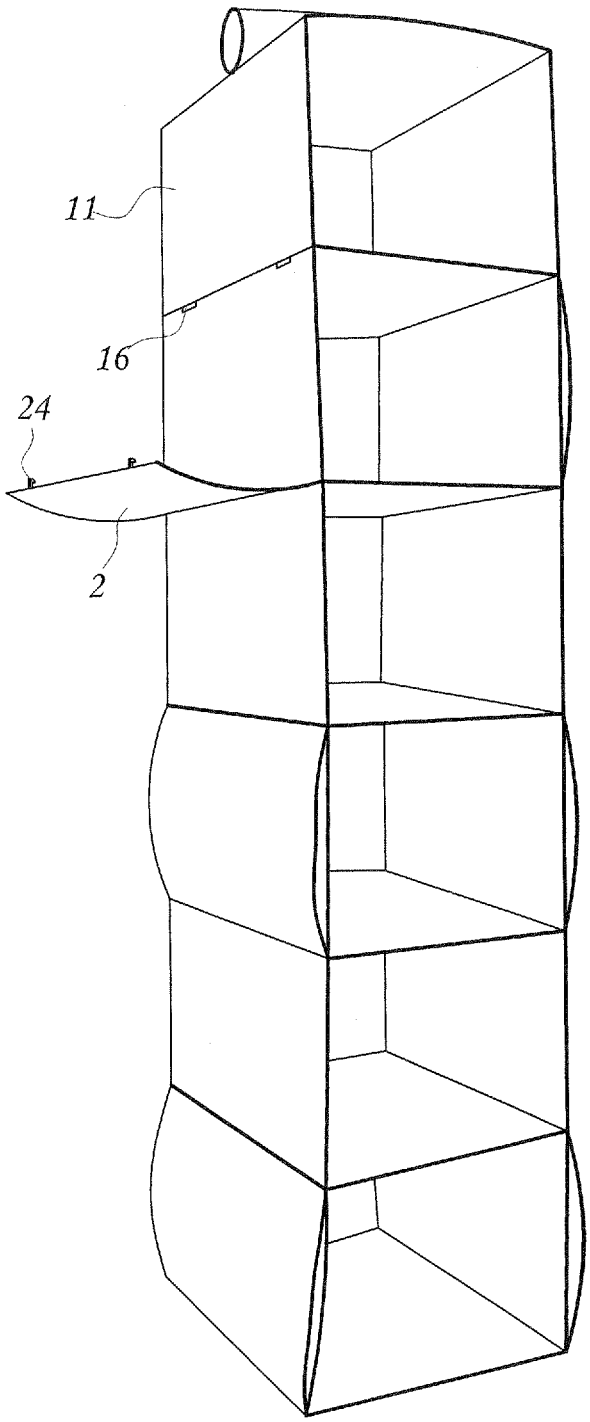
FIG. 6 is an elevational view of another alternate form of the hanging closet in accordance with the present invention.

In another alternate form of the present invention as shown in FIG. 6, multiple sets of hook holes 16 and a plurality of suspension flaps 2 are alternatively arranged on the outer surface of one or each of the two opposing sidewalls 11 at different elevations corresponding to the partition panels 14. Further, each suspension flap 2 has one end, namely, the fixed end fixedly fastened to the associating sidewall 11 and an opposite end, namely, the free end provided with a set of hooks 24 for hooking in one adjacent set of hook holes 16. By means of hooking the hooks 24 of one suspension flap 2 into one adjacent set of hook holes 16, the free end of each suspension flap 2 is secured to the associating sidewall 11 of the closet body 1 so that each suspension flap 2 defines with the associating sidewall 11 of the closet body 1 a storage space for keeping things.

Figure 7:
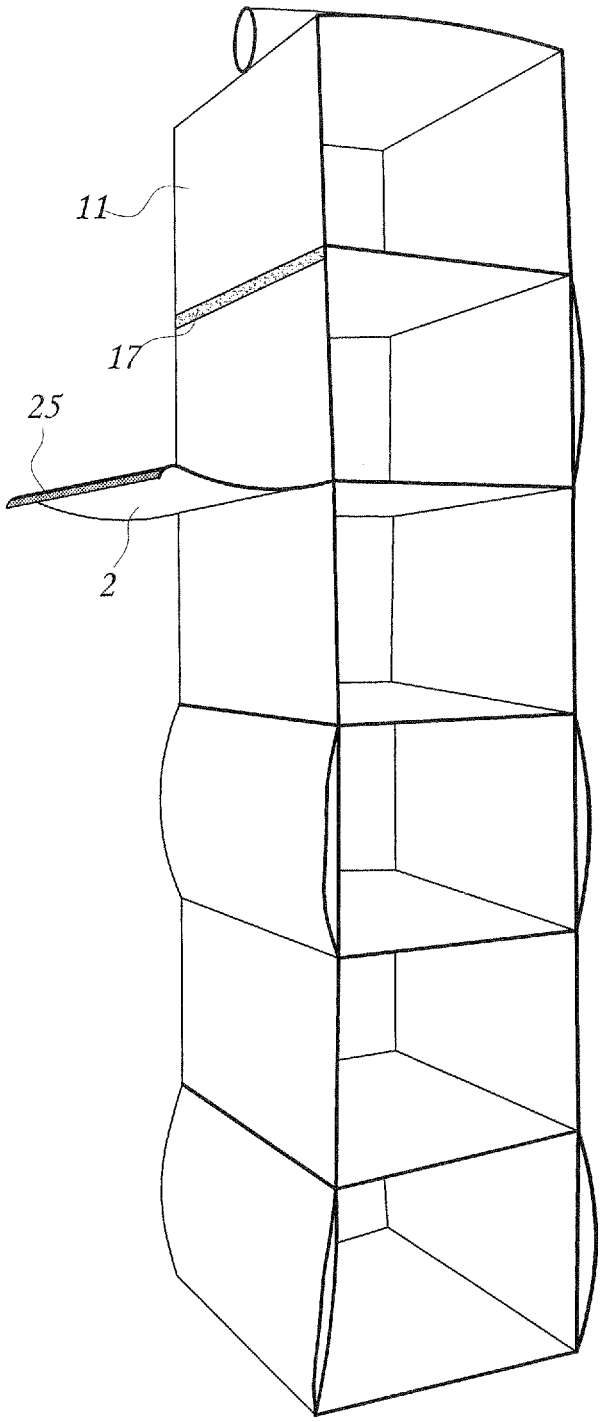
FIG. 7 is an elevational view of still another alternate form of the hanging closet in accordance with the present invention.

In still another alternate form of the present invention as shown in FIG. 7, multiple loop strips 17 and a plurality of suspension flaps 2 are alternatively arranged on the outer surface of one or each of the two opposing sidewalls 11 at different elevations. Further, each suspension flap 2 has one end, namely, the fixed end fixedly fastened to the associating sidewall 11 and an opposite end, namely, the free end provided with a strip of hook material 26 for fastening to one adjacent strip of loop material 17. By means of fastening the strip of hook material 26 of one suspension flap 2 to one adjacent strip of loop material 17, the free end of each suspension flap 2 is secured to the associating sidewall 11 of the closet body 1 so that each suspension flap 2 defines with the associating sidewall 11 of the closet body 1 a storage space for keeping things.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A hanging closet, comprising:

a closet body, said closet body comprising two opposing sidewalls, a back wall, a plurality of horizontal partition panels connected between said two opposing sidewalls at different elevations and dividing a holding space of said closet body into vertically spaced storage spaces;

a plurality of suspension flaps fastened to at least one of said two opposing sidewalls of said closet body, each said suspension flap having a fixed end fixedly connected to each said sidewall of said closet body and a free end opposite to said fixed end; and fastening means adapted for securing the free end of each said suspension flap to an associating sidewall of said closet body at a different elevation relative to the fixed end such that each said suspension flap defines with the associating sidewall of said closet body a storage space;

wherein said fastening means comprises a plurality of first sleeves fixedly and horizontally located on at least one of said two opposing sidewalls of said closet body, pairs of second sleeves respectively fixedly located on the free ends of said suspension flaps, and rod members insertable into said first sleeves and said pairs of second sleeves to secure the free ends of said suspension flaps to said first sleeves, said pairs of second sleeves located on the free end of each said suspension flap being spaced from each other at a distance equal to the length of said first sleeves.

2. The hanging closet as claimed in claim 1, wherein said suspension flaps and said first sleeves of said fastening means are alternately arranged on one said sidewall of said closet body at different elevations corresponding to said partition panels.

3. The hanging closet as claimed in claim 1, wherein said suspension flaps and said first sleeves of said fastening means are alternately arranged on each of said two opposing sidewalls of said closet body at different elevations corresponding to said partition panels.

4. The hanging closet as claimed in claim 1, wherein each said suspension flap further comprises a third sleeve located on each of two opposing lateral sides thereof and extending in a perpendicular manner relative to the extending direction of said second sleeves, and a reinforcing rod member respectively inserted into each said third sleeve.

* * * * *